United States Patent [19]

Berndt et al.

[11] 4,082,547

[45] Apr. 4, 1978

[54] INTERMETALLIC COMPOUNDS AND METAL PURIFICATION

[75] Inventors: Uwe Berndt, Karlsruhe; Bernhard Erdmann, Lampertheim; Cornelius Keller, Karlsruhe, all of Germany

[73] Assignee: Gesellschaft fur Kernforschung m.b.H., Karlsruhe, Germany

[21] Appl. No.: 474,864

[22] Filed: May 30, 1974

Related U.S. Application Data

[62] Division of Ser. No. 265,796, Jun. 23, 1972, Pat. No. 3,994,718.

[30] Foreign Application Priority Data

Mar. 30, 1972 Germany ..... 2215694
Mar. 30, 1972 Germany ..... 2215695

[51] Int. Cl.[2] ..... C22C 43/00
[52] U.S. Cl. ..... 75/122.7; 423/250
[58] Field of Search ..... 75/122.7; 423/5, 250

[56] References Cited

PUBLICATIONS

Erdmann, Bernhard; "Preparation... Reduction" Oct. 1971 as Abstracted in Nuclear Science Abstracts, vol. 26, No. 23287.

V. I. Kutaitsev et al., "Phase... IB" Soviet Atomic Energy, vol. 23, pp. 1279–1287, 1967.

Bronger, W. "Preparation... Metals," J. Less-Common Metals, vol. 12 (1967), pp. 63–68.

Dwight, A. E. et al., "Some $AB_3$ ... Metals," Acta Cryst., 14:75–6 (1961) as abstracted in Nuclear Science Abstracts 15:11627.

Elliott, R. P. *Constitution of Binary Alloys, First Supplement* McGraw-Hill Book Co., New York, 1965, pp. 751–753.

Shunk, F. A. *Constitution of Binary Alloys, Second Supplement* McGraw-Hill Book Co., New York, 1969, p. 622.

Cotton, F. A. et al., *Advanced Inorganic Chemistry,* Interscience Publishers, New York, 1972, pp. 1079–1081.

*Primary Examiner*—Benjamin R. Padgett
*Assistant Examiner*—Deborah L. Kyle
*Attorney, Agent, or Firm*—Spencer & Kaye

[57] ABSTRACT

By thoroughly mixing a compound of a base metal with a metal of the eighth subgroup of the Periodic Table, heating the resultant to a temperature in excess of 800° C at which it is subjected to a stream of hydrogen and treating thus-obtained intermetallic compound at a still higher temperature and under a high vacuum, a base metal having a purity of at least 98 percent results. When the base metal is an actinide, an alloy or a mixture of alloy and intermetallic compound may be obtained in lieu of the indicated intermetallic compound.

4 Claims, No Drawings

INTERMETALLIC COMPOUNDS AND METAL PURIFICATION

CROSS-REFERENCE TO RELATED APPLICATION

This application is a division of copending application Ser. No. 265,796, filed June 23rd, 1972 now U.S. Pat. No. 3,994,718.

BACKGROUND OF THE INVENTION

Metals are obtained from compounds containing them by processes, such as electrolysis (in aqueous solution or in a melt) aluminothermal reduction, reduction by alkali metal or alkaline earth metal, and reduction (of the metal oxide or hydroxide) with carbon or hydrogen. Hydroxides of, for example, iron, cobalt, nickel, germanium, molybdenum, ruthenium, tungsten, rhenium and osmium are reduced to their respective metals with hydrogen.

The treatment with hydrogen of oxides (or hydroxides) of metals of the first and second main groups or the third, fourth and fifth subgroups of the Periodic Table of Elements, however, does not lead to reduction to the metal. A series of metals, including lithium, calcium, strontium, and barium are derived from their respective halogen salts by melt electrolysis. Reducing oxides (or hydroxides) of these metals with hydrogen has thus far not been possible.

Hydrogen reduction of actinide base metals, such as americium, californium and curium, is not known. Americium is obtained by reduction of americium trifluoride with lithium, barium, lanthanum or thorium at 1100° to 1200° C.

Separation of metals from one another has thus far been effected either during processing of ores containing the metals (virtually always requiring subsequent cleansing), by electrolysis, or via the detour of preparing inorganic or organic compounds of the metals with subsequent separation of the compounds from one another and conversion of the individual compounds into respective metals.

Preparation of intermetallic compounds is usually effected by melting pure metals together. Only a relatively small number of intermetallic compounds with a high proportion of the more noble metal has been obtained by hydrogen reduction from oxides (or hydroxides) of lithium, aluminum, scandium, yttrium, silicon, titanium, vanadium, niobium, tantalum, chromium, from rare earth metal oxides or from alkaline earth oxides, respectively, with platinum also with rhodium, palladium and iridium in the case of titanium and with palladium in the case of silicon (H. Schulz, K. Ritapal, W. Bronger, W. Klemm "Ueber die Reaktion von Elementen der achten Nebengruppe mit Oxiden unedler Metalle im Wasserstoffstrom" [The Reaction of Elements of the Eighth Subgroup with Oxides of Base Metals in a Stream of Hydrogen] Magazine for inorganic and general chemistry, volume 357, 1968, pages 299–313), (W. Bronger, W. Klemm, "Darstellung von Legierungen des Platins mit unedlen Metallen" [Obtaining Platinum Alloys with Base Metals], Magazine for inorganic and general chemistry, volume 319, 1962/63, pages 58–81) and (W. Bronger "Preparation and X-Ray Investigation of Platinum Alloys with the Rare-Earth Metals [$Pt_5Ln$ and $Pt_3Ln$-Phases]", Journal of the Less Common Metals, volume 12, 1967, pages 63–68). The described intermetallic compounds are listed in the following Table 1:

TABLE 1

| Intermetallic Compound | Reduction Temperature (± 50)° C | Type of Structure |
|---|---|---|
| $Pt_7Li$ | 1000 | $Pt_7Mg$ |
| $Pt_3Mg$ | 1150 | $Cu_3Au$ |
| $Pt_3Al$ | 1200 | $Cu_3Au$ |
| $Pd_2Si$ | 1100 | $Fe_2P$ |
| $Pt_2Ca$ | 1200 | $Cu_2Mg$ |
| $Pt_5Ca$ | 1200 | $Cu_5Ca$ |
| $Pt_3Sc$ | 1200 | $Cu_3Au$ |
| $Pt_3Ti$ | 1200 | $Cu_3Au$ |
| $Pd_3Ti$ | 1200 | $Ni_3Ti$ (hex.) |
| $Ir_3Ti$ | 1550 | $Cu_3Au$ |
| $Rh_3Ti$ | 1550 | $Cu_3Au$ |
| $Pt_3V$ | 1000 | $Al_3Ti$ |
| $Pt_3Cr$ | 1000 | $Cu_3Au$ |
| $Pt_2Sr$ | 1200 | $Cu_2Mg$ |
| $Pt_3Sr$ | 1200 | unknown |
| $Pt_5Sr$ | 1200 | $Cu_5Ca$ |
| $Pt_5Y$ | 1200 | $Pt_5Tb$ |
| $Pt_3Nb$ | 1200 | $Cu_3Ti$ |
| $Pt_2Ba$ | 1200 | $Cu_2Mg$ |
| $Pt_5Ba$ | 1200 | $Cu_5Ca$ |
| $Pt_3Ho$ | 1200 | $Cu_3Au$ |
| $Pt_3Er$ | 1200 | $Cu_3Au$ |
| $Pt_3Tm$ | 1200 | $Cu_3Au$ |
| $Pt_3Yb$ | 1200 | $Cu_3Au$ |
| $Pt_3Lu$ | 1200 | $Cu_3Au$ |
| $Pt_5La$ | 1200 | $Cu_5Ca$ (hex.) |
| $Pt_5Ce$ | 1200 | $Cu_5Ca$ (hex.) |
| $Pt_5Pr$ | 1200 | $Cu_5Ca$ (hex.) |
| $Pt_5Nd$ | 1200 | $Cu_5Ca$ (hex.) |
| $Pt_5Sm$ | 1300 | |
| $Pt_5Eu$ | 1300 | $Pt_5Sm$ |
| $Pt_5Gd$ | 1200 | $Pt_5Sm$ |
| $Pt_5Tb$ | 1200 | |
| $Pt_5Dy$ | 1200 | $Pt_5Tb$ |
| $Pt_5Ho$ | 1200 | $Pt_5Tb$ |
| $Pt_5Er$ | 1200 | $Pt_5Tb$ |
| $Pt_5Tm$ | 1200 | |
| $Pt_3Ta$ | 1200 | $Cu_3Ti$ |

The authors, W. Bronger et al, called this hydrogen reduction of metal oxides (or hydroxides) which leads to intermetallic compounds a "coupled reduction".

Intermetallic compounds of the actinide metals: thorium, uranium and plutonium, with rhodium, palladium, iridium and platinum have been described (A. E. Dwight et al, "Acta Crystallographica", Vol. 14, pages 75 and 76, 1961, and V. I. Kutaitsev et al, "Soviet Atomic Energy", Vol. 23, pages 1279 to 1287, 1967). To produce such binary compounds, the metals are melted together in very pure form in an electric arc. However, intermetallic compounds, or alloy phases or mixtures of intermetallic compounds and alloy phases of the actinides: protactinium, neptunium, americium, curium and californium, with metals of the eighth subgroup of the Periodic Table of elements, e.g. rhodium, palladium, iridium and platinum, are not known.

SUMMARY OF THE INVENTION

The present invention has several interrelated facets which are bound together by a method devised essentially for the purification of base metals with the aid of hydrogen at elevated temperatures, including purifying and separating metals from one another. This method includes:

(a) thorough mixing of a compound of a base metal with a metal of the eighth subgroup of the Periodic Table;

(b) heating the thus-obtained admixture to a temperature in excess of 800° C at which it is subjected to a stream of hydrogen; the hydrogen must be of an extremely high purity, and the heating can actually be effected by the hydrogen stream; intermetallic compounds are thus formed;

(c) heating resulting intermetallic compounds to a still higher temperature and under a high vacuum to volatilize base metal therein; when more than one base metal is present, each is volatilized in turn; the one having the lowest volatilization temperature is separated first;

(d) cooling each volatilized base metal under a high vacuum in an inert gas atmosphere; the purity of base metals thus obtained is at least 98 percent.

Separate facets of the invention include intermetallic compounds of high purity, particularly those ($A_yB_x$) of actinides with metals of the eighth subgroup of the Periodic Table, alloys ($A_zB_{1-z}$) of actinides with metals of the eighth subgroup of the Periodic Table, a method for preparing such compounds, alloys and mixtures of the two, and a method for using such compounds, alloys and mixtures.

The intermetallic compounds, the alloys and mixtures of the two are prepared by steps (a) and (b) of the previouslynoted method.

An object of the present invention is thus to provide a method for producing base metals of high purity on a laboratory scale as well as on a larger scale in a simpler and more economical manner than heretofore possible. Moreover, the method must be capable of producing separate metals in one unitary process from a starting material containing a plurality of metals even when respective concentrations of these metals vary widely.

A further object is to prepare novel intermetallic compounds, as well as alloy phases or mixtures of intermetallic compounds with alloy phases, as well as to provide a method (which is simpler and more economical than melting together pure metals) for producing these materials.

METAL PURIFICATION

One or more metal-containing compounds are thoroughly mixed with at least one metal of the eighth subgroup of the Periodic Table of Elements; the thus-obtained mixture is heated to a temperature of more than 800° C and treated thereat with a stream of highly purified hydrogen; the resulting highly pure intermetallic compound(s) is (are) heated in a further heat treatment stage at a temperature higher than that of the preceding stage and under a high vacuum (approximately $10^{-5}$ to $10^{-6}$ torr); and volatile (under employed conditions) metal present is obtained in a purity of more than 99%, by cooling under the high vacuum or in an inert gas atmosphere. When starting material includes more than one-metal-containing compound, the metal need not be the same in each such compound.

When a plurality of metals is present in the starting material, (a) compounds of the metals (to be separated) are, correspondingly, thoroughly mixed with at least one metal of the eighth subgroup of the Periodic Table of Elements, (b) the thus-obtained admixture is treated in a first heat treatment stage with highly purified hydrogen at temperatures of more than 800° C, (c) resulting highly pure intermetallic compounds are heated (to effect fractional volatilization and separation of the metals) in further successive heat treatment stages, each having a higher temperature than the preceding stage, under a high vacuum (approximately $10^{-5}$ to $10^{-6}$ torr) and (d) the volatile metals are individually obtained (by cooling) with a purity of, e.g., more than 99%.

Employed metal compounds are advantageously oxides and/or fluorides. [Throughout the disclosure and claims all references to oxide(s) include hydroxide(s).] The metal-containing compounds are not restricted to these categories, which are cited merely for illustration and preference.

Base metals are obtained in the indicated high purity by this method. [Base metals include both those which oxidize rapidly and those whose hydroxides are soluble in water; they constitute an established recognized class of metals, including, e.g., lithium, calcium, strontium, barium, americium, curium and californium.]

Lithium, calcium, strontium, barium, americium, curium and californium are thus illustrative of metals which are obtained in essentially pure form according to the subject invention from intermetallic compounds with, e.g., rhodium, palladium, iridium or platinum by volatilization and recondensation. Purities in excess of 99 percent are readily attained.

According to a further modification (with significant advantage) of the present invention metal(s) of the eighth subgroup is (are) recirculated for subsequent use after obtained metals have been volatilized and separated therefrom.

The formed intermetallic compounds are virtually pure, having less than 1000 parts per million (ppm) of oxygen, less than 100 ppm of nitrogen and less than 100 ppm of hydrogen, as well as compositions which correspond to the general formula $C_vD_w$ where C is at least one metal from the first to fourth main groups or the third to seventh subgroups of the Periodic Table of Elements, D is at least one metal from the eighth subgroup, v is one of the numbers, 1, 2, 3, 5 and 7, and w is one of the numbers, 2, 3, 4, 5 and 7.

Exemplary of those metals (C) in the first to fourth main groups and the third to the seventh subgroups of the Periodic Table of Elements are:

| | | | | |
|---|---|---|---|---|
| lithium<br>rubidium<br>cesium | magnesium<br>calcium<br>strontium<br>barium | aluminum<br>gallium<br>indium | silicon<br>germanium<br>tin | scandium<br>yttrium<br>actinium |
| titanium<br>zirconium<br>hafnium | vanadium<br>niobium<br>tantalum | chromium<br>molybdenum<br>tungsten | manganese<br>rhenium | |

Metals (D) include iron, cobalt, nickel, ruthenium, palladium and osmium.

New intermetallic compounds are produced by "coupled reduction". Some of these are listed in Table 2*a*.

TABLE 2a

NOVEL INTERMETALLIC COMPOUNDS

| Intermetallic Compound ($B_xA_y$) | Reduction Temperature (± 50) ° C | Type of Structure |
|---|---|---|
| $Pt_3Pa$ | 1250 | $Cd_3Mg$ (hex.) |
| $Pt_5Pa$ | 1200 | $Ni_5U$ |
| $Pt_3Np$ | 1300 | $Ni_3Ti$ (hex.) |
| $Pt_5Np$ | 1250 | $Pt_5Tm$ |
| $Pt_2Am$ | 1400 | $Cu_2Mg$ |
| $Pt_5Am$ | 1200 | $Pt_5Sm$ |
| $Pt_2Cm$ | 1400 | $Cu_2Mg$ |
| $Pt_5Cm$ | 1250 | $Pt_5Sm$ |
| $Pt_5Cf$ | | |
| $Pd_3Np$ | 1350 | $Cu_3Au$ |
| $Pd_3Am$ | 1300 | $Cu_3Au$ |
| $Pd_3Cm$ | 1300 | $Cu_3Au$ |
| $Pd_3Cf$ | | |
| $Ir_3Pa$ | 1550 | $Cu_3Au$ |
| $Ir_2Np$ | 1550 | $Cu_2Mg$ |
| $Ir_2Am$ | 1550 | $Cu_2Mg$ |
| $Ir_2Cm$ | 1550 | $Cu_2Mg$ |
| $Ir_2Cf$ | | |
| $Rh_3Pa$ | 1550 | $Cu_3Au$ |
| $Rh_3Np$ | 1550 | $Cu_3Au$ |
| $Rh_2Am$ | 1550 | $Cu_2Mg$ |
| $Rh_3Am$ | 1550 | $Cu_3Au$ |

TABLE 2a-continued

| NOVEL INTERMETALLIC COMPOUNDS | | |
|---|---|---|
| Intermetallic Compound ($B_xA_y$) | Reduction Temperature (± 50) ° C | Type of Structure |
| $Rh_3Cm$ | 1550 | $Cu_3Au$ |

Furthermore, intermetallic compounds listed in Table 2*b* (previously produced by other methods, particularly by melting the metals together) have now been obtained by "coupled reduction" according to the present invention.

TABLE 2b

| FURTHER INTERMETALLIC COMPOUNDS | | |
|---|---|---|
| Intermetallic Compound | Reduction Temperature (± 50) ° C | Type of Structure |
| $Pd_{75}Mg_{25}$ | 1250 | $Cu_3Au$ (disordered) |
| $Pt_2Si$ | 1100 | $Zr_2H$ |
| $Pd_3Sc$ | 1250 | $Cu_3Au$ |
| $Rh_3Sc$ | 1550 | $Cu_3Au$ |
| $Pt_{75}V_{25}$ | 1200 | $Cu_3Au$ (disordered) |
| $Pd_3V$ | 1000 | $Al_3Ti$ |
| $Pd_{75}V_{25}$ | 1200 | $Cu_3Au$ (disordered) |
| $Ir_3V$ | 1500 | $Cu_3Au$ |
| $Rh_3V$ | 1500 | $Cu_3Au$ |
| $Pd_{75}Cr_{25}$ | 1150 | $Cu_3Au$ (disordered) |
| $Ir_3Cr$ | 1500 | $Cu_3Au$ |
| $Rh_3Cr$ | 1500 | Phase with closest Hexagonal packing |
| $Pt_3Mn$ | 950 | $Cu_3Au$ |
| $Pd_3Mn$ | 1050 | $Cu_3Au$ |
| $Pd_5Sr$ | 1250 | $Cu_5Ca$ |
| $Pt_3Y$ | 1350 | $Cu_3Au$ |
| $Pd_3Y$ | 1300 | $Cu_3Au$ |
| $Pt_3Zr$ | 1200 | $Ni_3Ti$ (hex.) |
| $Pd_3Zr$ | 1300 | $Ni_3Ti$ (hex.) |
| $Ir_3Zr$ | 1550 | $Cu_3Au$ |
| $Rh_3Zr$ | 1550 | $Cu_3Au$ |
| $Pd_3Nb$ | 1200 | $Al_3Ti$ |
| $Ir_3Nb$ | 1500 | $Cu_3Au$ |
| $Rh_3Nb$ | 1500 | $Cu_3Au$ |
| $Pd_5Ba$ | 1250 | $Cu_5Ca$ |
| $Pt_2La$ | 1400 | $Cu_2Mg$ |
| $Pt_2Ce$ | 1400 | $Cu_2Mg$ |
| $Pt_2Pr$ | 1400 | $Cu_2Mg$ |
| $Pt_2Nd$ | 1400 | $Cu_2Mg$ |
| $Pt_2Sm$ | 1400 | $Cu_2Mg$ |
| $Pt_2Eu$ | 1400 | $Cu_2Mg$ |
| $Pt_2Gd$ | 1400 | $Cu_2Mg$ |
| $Pt_3Tb$ | 1300 | $Cu_3Au$ |
| $Pt_3Dy$ | 1250 | $Cu_3Au$ |
| $Pd_3La$ | 1350 | $Cu_3Au$ |
| $Pd_3Ce$ | 1350 | $Cu_3Au$ |
| $Pd_3Pr$ | 1350 | $Cu_3Au$ |
| $Pd_3Nd$ | 1350 | $Cu_3Au$ |
| $Pd_3Sm$ | 1350 | $Cu_3Au$ |
| $Pd_3Eu$ | 1350 | $Cu_3Au$ |
| $Pd_3Gd$ | 1350 | $Cu_3Au$ |
| $Pd_3Tb$ | 1350 | $Cu_3Au$ |
| $Pd_3Dy$ | 1350 | $Cu_3Au$ |
| $Pd_3Ho$ | 1350 | $Cu_3Au$ |
| $Pd_3Er$ | 1350 | $Cu_3Au$ |
| $Pd_3Tm$ | 1350 | $Cu_3Au$ |
| $Pd_3Yb$ | 1350 | $Cu_3Au$ |
| $Pd_3Lu$ | 1350 | $Cu_3Au$ |
| $Pt_3Hf$ | 1200 | $Ni_3Ti$ (hex.) |
| $Pt_{75}Hf_{25}$ | 1200 | $Cu_3Au$ (disordered) |
| $Pd_3Hf$ | 1300 | $Ni_3Ti$ (hex.) |
| $Pd_{75}Hf_{25}$ | 1300 | $Cu_3Au$ (disordered) |
| $Ir_3Hf$ | 1550 | $Cu_3Au$ |
| $Rh_3Hf$ | 1550 | $Cu_3Au$ |
| $Pd_3Ta$ | 1200 | $Al_3Ti$ |
| $Ir_3Ta$ | 1500 | $Cu_3Au$ |
| $Rh_3Ta$ | 1500 | $Cu_3Au$ |
| $Pt_5Th$ | 1200 | $Pt_5Sm$ |
| $Pd_4Th$ | 1400 | $Cu_3Au$ |
| $Rh_3Th$ | 1550 | $Cu_3Au$ |
| $Pt_3U$ | 1200 | $Cd_3Mg(Ni_3Sn)$(hex.) |
| $Pt_5U$ | 1200 | $Ni_5U(Be_5Au)$ |
| $Pd_4U$ | 1250 | $Cu_3Au$ |
| $Pd_5U$ | 1200 | unbekannt (unknown) |
| $Ir_3U$ | 1550 | $Cu_3Au$ |
| $Rh_3U$ | 1550 | $Cu_3Au$ |
| $Pt_2Pu$ | 1400 | $Cu_2Mg$ |
| $Pt_3Pu$ | 1200 | $Cu_3Au$ |
| $Pt_5Pu$ | 1200 | $Pt_5Sm$ |
| $Pd_3Pu$ | 1300 | $Cu_3Au$ |
| $Ir_2Pu$ | 1550 | $Cu_2Mg$ |
| $Rh_2Pu$ | 1550 | $Cu_2Mg$ |

TABLE 2b-continued

| FURTHER INTERMETALLIC COMPOUNDS | | |
|---|---|---|
| Intermetallic Compound | Reduction Temperature (± 50) ° C | Type of Structure |
| $Rh_3Pu$ | 1550 | $Cu_3Au$ |

With the first two process steps of the method according to the present invention, intermetallic compounds, for example $Pd_3Ln$-compounds of lanthanides (Ln) [lanthanum to lutecium], $Pt_2Ln$-compounds of lanthanides [lanthanum to gadolinium] and $Pt_3Ln$-compounds of lanthanides [terbium to dysprosium], which previously could not be produced in a "coupled reduction" [W. Bronger (J. Less-Common Metals, volume 12, 1967, pages 63–68) obtained in the cases of $Yb_2O_3$ and $Lu_2O_3$ only $Pt_3Ln$-compounds mixed with free platinum], are obtained in pure form.

In an advantageous embodiment of the present invention stoichiometric quantities of lithium oxide ($LiO_2$) and powdered platinum are thoroughly mixed and heated in a stream of highly purified hydrogen to a temperature of 800° to 1000° C or more. The resulting intermetallic compound (of the stoichiometric composition $LiPt_7$) is brought to 1000° C or more under a high vacuum, and volatilized lithium is condensed by cooling.

To obtain calcium by the process of the present invention, stoichiometric quantities of, e.g., calcium fluoride ($CaF_2$) and of powdered platinum are thoroughly mixed, heated to a temperature in the range of 1000° to 1400° C and subjected thereat to a stream of highly purified hydrogen. The resulting $CaPt_2$ is thermally decomposed, and volatilized calcium is condensed by cooling.

Of great advantage is a further modification of the present invention in which an admixture of powdered oxides of americium, curium and californium with powdered platinum or palladium is thoroughly mixed and then heated in a stream of highly purified hydrogen to a temperature of approximately 1000° C. The resulting intermetallic mixed phase (Am, Cm, Cf)$Pt_5$ is heated under a high vacuum in further heat treatment stages to approximately 1100° to 1250° C in order to volatilize the californium, to approximately 1300° C or more to volatilize the americium and to 1500° C and more to volatilize the curium, the volatile metals being thus separated from one another and condensed by cooling.

Hydrogen used for the coupled reduction (which is substantially free from water vapor and oxygen) is purified according to W. Bronger by diffusion through heated nickel capillaries. A hydrogen/nitrogen mixture can, alternatively, be used; such a mixture results at high temperatures, e.g. a temperature of at least about 1000° C, from ammonia which had previously been dried for several days over sodium with simultaneous cooling. Hydrogen purified in either of these ways is useful for obtaining a number of intermetallic compounds, but not for compounds containing the light actinides (thorium to americium) or for compounds of rare-earth metals with palladium since pure intermetallic phases are not thus obtained.

For these the hydrogen must be purified, e.g. as follows: In glass-lined steel apparatus, conventionally available three-ring hydrogen ("three ring" is a quality designation) is first conducted through a furnace in contact with platinum asbestos/titanium sponge and heated to 650° C and then over a molecular sieve with a pore diameter of 5A, as well as through a cooling trap cooled to −196° C. Fine purification is effected by conducting thus-prepared hydrogen through three consecutive washing flasks containing a sodium-potassium alloy which is liquid at room temperature. Hydrogen purified in this manner has low partial pressures for water vapor ($\leqq 10^{-7}$ torr) and oxygen ($\leqq 10^{-26}$ torr).

The glass-lined steel apparatus is composed of generally usable glass vessels and stainless steel components which can be purchased commercially. No patent protection is claimed for this apparatus. It is important to prevent the diffusion of air into the purified gas, which is ensured by the glass vessels and circular corrugated stainless steel lines (trademark and type "Boa Supra," 5 mm i.d.) as movable gas lines and by glass-metal seals with the proper finish. The interfaces and seals, respectively, of the glass and metal parts (e.g., ground connections) are coated with a thermoplastic cement (for instance, trademark "Glaskitt RZ 117") and, after curing of the cement, sprayed with teflon high-vacuum spray several times for complete sealing.

The "Dreiring" grade hydrogen commercially obtainable in steel cylinders (99.998% purity; impurities: $O_2 < 2$ vpm, $H_2O < 10$ vpm and $N_2$ approximately 10 vpm) is passed from the steel cylinder through a rotameter for flow measurement, afterwards through a furnace loaded with platinum asbestos and titanium sponge, then flows through three series connected vessels with a commercial molecular sieve with 5 A pore diameter (e.g., a product of Merck, Darmstadt, Federal Republic of Germany), flows through a cold trap covered with liquid nitrogen and through an empty vessel and is run through another three vessels with a liquid sodium-potassium alloy, another empty vessel and finally through another cold trap with liquid nitrogen for very high purification.

Titanium sponge and platinum asbestos are commercial grade substances. Platinum asbestos is an asbestos of a quality containing approximately 15 wt.% of Pt. The contact time of hydrogen with these substances in the furnace is between 0.5 and 4 minutes, depending on the flow rate.

The molecular sieve used may be any commercial molecular sieve of approximately 5 A pore diameter.

The sodium-potassium alloy is prepared as follows:

Commercial grade sodium and potassium are washed in petroleum ether (b.p. approx. 40° C), and afterwards the adsorbed petroleum ether is sucked off at room temperature in the high vacuum (for some 40 hours). Both metals are then fused in a K:Na ratio of 2.5 : 1 and filtered through a glass frit under a nitrogen atmosphere.

However, any equipment of a different type or composition can be used for hydrogen purification, if the purification effect is the same and if the system will deliver hydrogen of the desired purity.

A great advantage of the method of the present invention is that it can be used in many ways. It is not a special method for obtaining a few metals with similar characteristics, but can just as well be used for such different metals as lithium, barium, europium, californium or manganese, i.e. for metals from the main and subgroups of the Periodic Table. The method does not require a certain type of substance for starting material; oxides, hydroxides, carbonates and fluorides (possibly even carbides or nitrides) are suitable.

INTERMETALLIC COMPOUNDS AND ALLOYS

By the first two steps of the described process intermetallic compounds having the formula $A_yB_x$, alloy phases having the formula $A_zB_{1-z}$ and mixtures of intermetallic compounds with alloy phases are prepared. In these formulae A signifies at least one actinide of the group: protactinium, neptunium, americium, curium and californium; B signifies at least one "subgroup-VIII" metal, such as rhodium, palladium, iridium and platinum; $y$ is equal to one; $x$ is one of the integers 2, 3 and 5; and $z$ is less than 0.2.

Intermetallic compounds according to the present invention are characterized by the stoichiometric compositions enumerated in Table 2*a* and their degree of purity, i.e. less than 1000 parts per million (ppm) of oxygen, less than 100 ppm of nitrogen and less than 100 ppm of hydrogen. Alloy phases according to the present invention are characterized, e.g., by such designations as $Pd_{0.9}Am_{0.1}$, $Ir_{0.9}Am_{0.1}$, $Ir_{0.9}Cm_{0.1}$ and $Pt_{0.95}Np_{0.05}$, which represent atomic relationships in the alloys. Mixtures of intermetallic compounds and alloy phases according to the present invention are those wherein the intermetallic compound(s) and the alloy phase(s) contain at least one metal from the actinide group comprising protactinium, neptunium, americium, curium and californium and at least one metal from the eighth subgroup of the Periodic Table of Elements.

The solution of part of the problem which relates to producing intermetallic compounds, alloy phases and/or mixtures of intermetallic compounds with alloy phases is achieved by the present invention in an advantageous manner. Actinide compounds, after being thoroughly mixed with metal of the eighth subgroup of the Periodic Table of Elements, are heated in a stream of purified hydrogen to temperatures of more than 1000° C and are then cooled in an inert gas atmosphere.

According to an advantageous embodiment of the method of the present invention the employed actinide compounds are actinide oxides and/or actinide fluorides.

The preparation of intermetallic compounds, alloy phases or mixtures of these substances is a function of the respective temperature and the ratio of weights of the reaction partners used. Thus, e.g., the intermetallic compound $Pd_3V$ (ordered structure) is obtained at 1000° C and the alloy phase $Pd_{75}V_{25}$ (disordered structure) at 1200° C, if mixtures with an atomic ratio of Pd:V = 3:1 are made to react. A mixture of intermetallic phases as the reaction product, e.g., a mixture of the intermetallic compounds $Pt_2Am$ and $Pt_5Am$, will result if a mixture, in this case of Pt:Am of 3:1 or 4:1, is used under the customary reaction conditions. Highly purified hydrogen is used for all reactions. The reaction times have the same lengths for intermetallic compounds, alloys or phases of alloys or for mixtures of intermetallic compounds and/or alloys and alloy phases. Even if different basic materials are employed, e.g., actinide oxide or fluoride, the conditions of preparation remain the same in each case, if the same product is desired. Only the reaction temperature and the ratio of the reaction partners to be used determine the product.

The intermetallic compounds, alloys or alloy phases and mixtures of intermetallic compound(s) with alloy and/or alloy phase(s) are useful as energy and radiation sources.

Am-241 as $AmO_2$ is usually employed as an $\alpha$- or $\gamma$-radiation source. Pressing or sintering of this oxide into a compact and durable pellet requires more expenditure. However, if, e.g., $Pd_3Am$ is prepared (example 7), the product obtained as a powder can be brought into the desired form by fusion. Also a metal pellet fabricated by pressing and sintering is more stable mechanically.

This procedures appears to be particularly advantageous when Am-241 is used as the $\alpha$-radiation source. Electrolysis or vapor deposition can be employed to apply a thin protective coating, e.g., of aluminium or gold, on a preshaped $Pd_3Am$ body which leaves the passage of $\alpha$-rays almost unaffected but prevents the environment from being contaminated by the substance. Due to the brittleness of oxide pellets, such protective coating cannot be applied to them or applied as a thick layer only; however, in general coating with a foil is preferred which, for safety reasons, must be thicker than a vapor-deposited layer. On the other hand, this will reduce the external range of $\alpha$-rays.

From the preceding description an artisan in the subject art will understand and be able to practice the presented invention to the fullest extent. The following specific embodiments are merely illustrative and do not, in any way, limit either the disclosure or the appended claims. Throughout the examples the employed hydrogen is that which is specially purified in glass-lined steel apparatus in contact with platinum asbestos/titanium sponge at 650° C before being passed over a molecular sieve, through a cooling trap and washed with liquid sodium-potassium alloy, as previously described. References to "fine powder" or "finely powdered" denotes an average particle size from about 10 $\mu$. Although the reactions outlined above can be performed also with coarser powder and metal chips, respectively, this will require longer reaction times and higher reaction temperatures.

EXAMPLE 1

Purification of lithium from $Li_2O$.

A finely powdered mixture of 1 mMol [29.9 milligrams (mg)] of $Li_2O$ (produced by thermal decomposition of LiOH at approximately 600° C in vacuo) and 7 mMol (1365.6 mg) of platinum black react in a purified hydrogen stream at 1000° C within 20 hours to form $LiPt_7$. This intermediate product is heated in a high vacuum at $\leqq 10^{-5}$ torr to about 1200° C. At a cooled point of the apparatus the lithium evaporating from the $LiPt_7$ is thus deposited with high purity.

Replacing the $Li_2O$ with an equivalent of $Li_2CO3$ yields the same intermediate and lithium of essentially the identical high purity.

EXAMPLE 2

Purification of calcium from $CaF_2$:

By tempering a homogeneously mixed powder consisting of 0.3 mMol (23.4 mg) of $CaF_2$ and 1.5 mMol (292.6 mg) of platinum black, the intermetallic compound $CaPt_5$ is obtained within 20 hours in a highly purified hydrogen stream at 1200° C. This compound is then decomposed in the same apparatus at 1400° C and under a high vacuum of $\leqq 10^{-5}$ torr, the calcium evaporating and being isolated at a cooled part of the apparatus to a yield of about 98%. Remaining platinum is recirculated for admixture with $CaF_2$ for further production of essentially pure calcium.

EXAMPLE 3

Separation of the metals americium, curium and californium from one another:

To a finely powdered mixture of 0.2 mMol (54.6 mg) of $AmO_2$, 0.1 mMol (27.6 mg) of $CmO_2$, and 1.5 mMol (292.6 mg) of platinum black, tracer quantities ($\sim 1\mu$ Ci) [$\sim 1$ $\mu$Ci Cf-252 corresponds to about $10^{-8}$ g Cf-252] Cf-252 solution are added and the resultant is dried up. This preparation is subsequently heated in a purified hydrogen stream to 1100° C for 35 hours. A mixed phase (Am, Cm, Cf) $Pt_5$ results. This phase is heated under a high vacuum ($\leqq 10^{-5}$ torr) for 30 hours to 1200° C, whereby Cf-252 quantitatively evaporates (counting the spontaneously split neutrons of a test residue which resulted in 97 $\pm$ 5% removal of Cf-252 from the residue. After increasing the temperature to 1350° to 1400° C, the americium is evaporated while less volatile curium remains as a residue ($CmPt_5$ + Pt). This, however, is also volatilized under the high vacuum above 1500° C.

Replacing the platinum black with stoichiometric amount of powdered palladium yields essentially the same results.

The fact that more difficulty reduceable oxides, i.e. oxides of base metals, can be more easily reduced in the presence of more noble metals is a result of the increase in the oxygen partial pressure of the oxide at a given temperature due to the presence of the more noble metal. Orientation experiments in which mixtures of the metals: iron, nickel and cobalt, with one of the oxides: $Cr_2O_3$, $V_2O_5$, $Nb_2O_5$, $Ta_2O_5$, $ZrO_2$, $SiO_2$ and $Al_2O_3$, are heated to 1200° in a stream of carefully purified hydrogen reveal that, in this way, alloys (which are homogeneous in the solid state) of the iron metals with, for example, chromium, are produced with high chromium concentrations. Likewise, Nb-Ni alloys are produced by reduction with hydrogen of mixtures of niobium pentoxide with nickel (whereas reduction of pure $Nb_2O_5$ with hydrogen does not lead to the metal, but is completed with the oxide, $Nb_2O$), and V-Fe alloys are produced from mixtures of $V_2O_5$ with iron. Base metals are thus also obtainable from compounds via their intermetallic compounds with iron, nickel or cobalt.

EXAMPLE 4

Production of $Rh_3Np$:

A finely powdered mixture of 1.0 mMol (269.0 mg) of $NpO_2$ and 3.0 mMol (308.7 mg) of rhodium-black is heated to 1550° C in a stream of purified hydrogen for 60 hours and then slowly cooled to room temperature ($\sim$20° C).

EXAMPLE 5

Production of $Pt_3Np$:

A finely powdered mixture of 0.5 mMol (147.0 mg) of $NpF_3$ and 1.5 mMol (292.6 mg) of powdered platinum is heated for 24 hours to 1000° C and then for 24 hours to 1300° C in a stream of purified hydrogen and then cooled slowly to room temperature. Analysis of the preparation yields the following values which indicate the high purity of the preparation: 580 ppm of $O_2$, $\leqq 100$ ppm of $N_2$, $\leqq 80$ ppm of $H_2$.

EXAMPLE 6

Production of $Pt_5Np$:

A finely powdered mixture of 0.5 mMol (134.5 mg) of $NpO_2$ and 2.5 mMol (487.7 mg) of platinum black is heated for 40 hours to 1250° C in a stream of purified hydrogen. Thereafter the resultant was slowly cooled to room temperature. An analysis of the resultant showed: 540 ppm of $O_2$, ≦100 ppm of $N_2$, ≦20 ppm of $H_2$.

EXAMPLE 7

Production of $Pd_3Am$:

A homogeneously mixed, fine powder consisting of 0.25 mMol (68.3 mg) of $^{241}AmO_2$ and 0.75 mMol (79.8 mg) of palladium black is heated for 60 hours at 1300° C in a stream of purified hydrogen and then slowly cooled to room temperature (~20° C) in a stream of helium.

EXAMPLE 8

Production of $Ir_2Cm$:

A finely powdered mixture of 0.1 mMol (27.6 mg) of $^{224}CmO_2$ and 0.2 mMol (38.4 mg) of iridium-black is heated for 60 hours to 1550° C in a stream of purified hydrogen and then cooled slowly to room temperature.

EXAMPLE 9

Production of $Pd_{0.9}Am_{0.1}$:

A finely powdered mixture of 0.1 mMol (= 27.7 mg) of $AmO_2$ and 0.9 mMol (95.8 mg) of palladium black is heated for 40 hours at 1250° C in a stream of hydrogen and then slowly cooled to room temperature (ca.20° C) in a stream of helium.

EXAMPLE 10

Production of a $Pt_2Am$ + $Pt_5Am$ mixture:

A finely powdered mixture of 0.1 mMol (= 27.7 mg) of $AmO_2$ and 0.3 mMol (58.5 mg) of powdered platinum is heated for 24 h to 1250° C in a stream of purified hydrogen and then cooled slowly to room temperature. X-ray analysis showed that the product resulted consists of a mixture of $Pt_2Am$ and $Pt_5Am$. Other examples of intermetallic compounds above all of the general formula $C_vD_w$ (as described above) which, however, are not meant as a limitation, have been prepared by the procedure according to the invention:

$CD_2$:
$CaPt_2$, $SiPt_2$, $LaPt_2$, $CePt_2$, $PrPt_2$, $NdPt_2$, $SmPt_2$, $EuPt_2$, $GdPt_2$, $PuRh_2$, $PuIr_2$, $PuPt_2$, $CD_3$:
$ScRh_3$, $ScPd_3$, $YPd_3$, $YPt_3$, $LaPd_3$, $CePd_3$, $PrPd_3$, $NdPd_3$, $SmPd_3$, $EuPd_3$, $GdPd_3$, $TbPd_3$, $TbPt_3$, $DyPd_3$, $DyPt_3$, $HoPd_3$, $ErPd_3$, $TmPd_3$, $YbPd_3$, $LuPd_3$, $ZrRh_3$, $ZrPd_3$, $ZrIr_3$, $ZrPt_3$, $HfRh_3$, $HfPd_3$, $HfIr_3$, $HfPt_3$, $VRh_3$, $VPd_3$, $VIr_3$, $NbRH_3$, $NbPd_3$, $NbIr_3$, $TaRh_3$, $TaPd_3$, $TaIr_3$, $CrRh_3$, $CrIr_3$, $MnPd_3$, $MnPt_3$, $CD_4$: $ThPd_4$, $UPd_4$, $CD_5$: $CaPt_5$, $SrPd_5$, $BaPd_5$, $ThPt_5$, $UPd_5$, $UPt_5$, $PuPt_5$, $CD_7$: $LiPt_7$

This procedure can be applied also to the preparation of intermetallic compounds and their mixtures, respectively, of the formulae CD: e.g. ThPt $C_2D_7$: e.g. $Am_2Pt_7$ $C_3D_2$: e.g. $U_3Ir_2$ $C_3D_4$: e.g. $Th_3Pt_4$ $C_3D_5$: e.g. $Th_3Pt_5$ $C_5D_2$: e.g. $Pu_5Rh_2$ $C_5D_3$: e.g. $Pu_5Pt_3$ $C_5D_4$: e.g. $Pu_5Rh_4$ $C_7D_3$: e.g. $Th_7Pt_3$ It will be understood that the above description of the present invention is susceptible to various modifications, changes and adaptations, and the same are intended to be comprehended within the meaning and range of equivalents of the appended claims.

We claim:

1. An intermetallic actinide compound having one of the following stoichiometric compositions: $Rh_3Pa$, $Ir_3Pa$, $Pt_3Pa$, $Pt_5Pa$, $Rh_3Np$, $Pd_3Np$, $Ir_2Np$, $Pt_3Np$, $Pt_5Np$, $Rh_2Am$, $Rh_3Am$, $Pd_3Am$, $Ir_2Am$, $Pt_2Am$, $Pt_5Am$, $Rh_3Cm$, $Pd_3Cm$, $Ir_2Cm$, $Pt_2Cm$, $Pt_5Cm$, $Pd_3Cf$, $Ir_2Cf$ and $Pt_5Cf$.

2. An intermetallic compound according to claim 1 and of high purity, any oxygen impurity being less than 1000 parts per million, any nitrogen impurity being less than 100 parts per million, and any hydrogen impurity being less than 100 parts per million.

3. An alloy phase having one of the following compositions: $Pd_{0.9}Am_{0.1}$, $Ir_{0.9}Am_{0.1}$, $Ir_{0.9}Cm_{0.1}$, and $Pt_{0.95}Np_{0.05}$.

4. An intermetallic compound according to claim 1 in admixture with an alloy phase selected from the group consisting of $Pd_{0.9}AM_{0.1}$, $Ir_{0.9}Am_{0.1}$, $Ir_{0.9}Cm_{0.1}$, $Pt_{0.95}Np_{0.05}$ and mixtures thereof.

* * * * *